United States Patent [19]

Johansson et al.

[11] 4,012,859

[45] Mar. 22, 1977

[54] MECHANISM FOR FIREARMS

[75] Inventors: Lennart Johan Ivar Johansson, Eskilstuna; Eric Vilhelm Wallberg, Vallingby; Bjorn Weine Lindqvist, Eskilstuna, all of Sweden

[73] Assignee: Forenade Fabriksverken, Eskilstuna, Sweden

[22] Filed: Apr. 21, 1975

[21] Appl. No.: 569,801

[30] Foreign Application Priority Data

Apr. 23, 1974 Sweden ..... 7405471

[52] U.S. Cl. ..... 42/75 C; 42/17

[51] Int. Cl.[2] ..... F41C 11/00

[58] Field of Search ..... 42/17, 16, 75 C; 89/191 R

[56] References Cited

UNITED STATES PATENTS

| | | | |
|---|---|---|---|
| 2,050,038 | 8/1936 | Browning | 42/75 C |
| 2,455,644 | 12/1948 | Barnes | 42/75 C |
| 2,765,557 | 10/1956 | Roper | 42/17 |
| 2,887,808 | 5/1959 | Janson et al. | 42/17 |
| 2,926,445 | 3/1960 | Green et al. | 42/17 |
| 3,242,606 | 3/1966 | La Violette, Jr. | 42/17 |

*Primary Examiner*—Charles T. Jordan
*Attorney, Agent, or Firm*—Fleit & Jacobson

[57] ABSTRACT

A firearm mechanism, especially for automatic or semi-automatic shotguns, with a covering upwardly closed breech-block housing consisting of two mutually fitting and fixedly attached parts, an outer casing part made from sheet by pressing and a precision-cast inner part, which is stiffening the outer part and is provided with guiding surfaces for movable parts in the mechanism, e.g. a breech-block. The outer part is stiffened also by a lower mounting, closing the housing and having upstanding walls projecting in the housing. Cartridge feeding catches are arranged in the lower mounting, attached to its upstanding side walls.

5 Claims, 7 Drawing Figures

MECHANISM FOR FIREARMS

Figure 1:
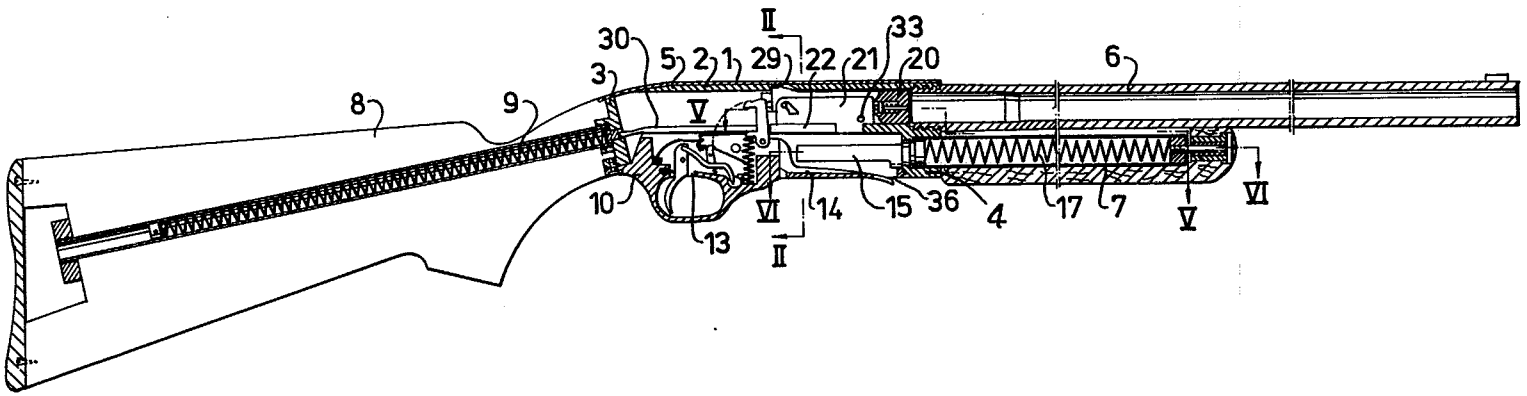

The present invention relates to firearm mechanisms, comprising an upwardly closed breech-block housing, a breech-block for guided reciprocating movement in it, operated by propelling and repelling means, and a lower mounting having upstanding walls projecting into a breech-block housing. More closely intended herewith are small arms of automatic or semi-automatic type, but even such in which reloading takes place by manual operation, e.g. so-called pump guns.

Incorporated in such mechanisms there are a plurality of displaceably or rotatably movable parts, for which guiding sliding surfaces or bearings are required in the breech-block housing or the lower mounting. It is usual hereby to arrange a so-called cartridge feeding flap and a trigger mechanism mounted in the lower mounting, which is advantageous when cleaning and adjusting the mechanism. These parts will on the one hand be more easily accessible, and on the other hand removal of the parts in the upper portion of the breech-block housing is facilitated. However, in weapons having a tubular magazine, it has been found more difficult to arrange in the lower mounting the cartridge feeding catches which prevent more than one cartridge at a time being fed into the housing. This has been especially difficult in automatic shotguns with tubular magazines placed below and parallel to the gun barrel. This has to do with the relatively large shot cartridges and said catches not being accommodated between the upstanding walls in a lower mounting in a conventional breech-block housing, unless this is made so wide that the gun has a clumsy appearance. Particularly with sporting and hunting guns it is very important from a selling point of view that the gun has a light and slender appearance and feels comfortable to handle. On the other hand, cartridge catches fitted in the breech-block housing are less accessible for cleaning, and cause problems when removing the moving parts in the upper portion of the housing, these being the breech-block and often an action piece carrying the breech-block.

Existing breech-block housings of the type in question are made from a block of steel by first milling away the greater portion of it, and then forming the necessary guiding and operating surfaces as well as recesses in the upper portion of the housing for the parts mentioned above, which are situated there. This means very expensive machining, since the tools must be introduced through the lower opening of the housing and work with long cantileverage, making it difficult to achieve the necessary dimensional and surface accuracy.

The invention relates to a mechanism which by means of a new and different breech-block housing provides an elegant solution to the problems hereinbefore discussed.

A housing according to the invention enables arranging cartridge catches in the forward portion of the lower mounting in automatic shotguns also, in spite of being able to make the housing so narrow that the gun will be very slender and have very clean lines. The absence on the outside of the housing of visible attachment devices for the cartridge catches, contributes to the elegant and slender appearance of the gun.

A great advantage is that the housing has completely smooth inner walls in its lower portion, which makes taking down and assembly of the mechanism very simple.

A breech-block housing according to the invention will furthermore be very simple and cheap to manufacture in comparison with a conventional housing.

The achievement of these advantages has been enabled by the invention having acquired the characteristics disclosed in the characterizing portion of claim 1.

Figure 7:
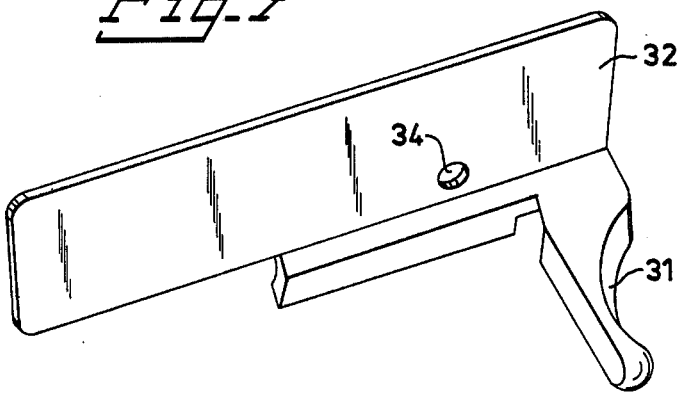

Since the invention, although it is with advantage practicable for different kinds of firearms, appears to be especially advantageous for automatic shotguns, it will be more closely described in connection with such a firearm. In order to illustrate the invention, the attached drawing is referred to in the description, where FIG. 1 shows a vertical longitudinal section of a gas-operated semi-automatic shotgun, with a breech-block housing according to the invention, there being certain portions shown in elevation or left without hatching for the sake of clarity, FIG. 2 shows a section II—II in FIG. 1 of a breech-block housing according to the invention, FIG. 3 shows a perspective view of a lower mounting, FIG. 4 shows a side view of an action piece provided with long, forwardly projecting rails and a cross-piece attached to them, together forming a slide, and a breech-block mounted in the action piece, FIG. 5 shows the same parts and thereto a cylinder block with two gas pistons driving the slide, seen in a section V—V in FIG. 1, FIG. 6 shows a tubular magazine and cartridge feeding means seen in a section VI—VI in FIG. 1 and FIG. 7 shows a perspective view of a handle intended to be attached to the breech-block.

Figure 2:
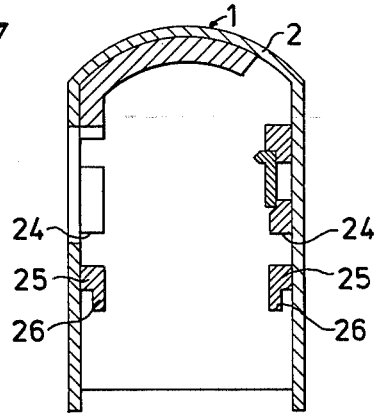

The automatic shotgun shown in FIG. 1 has an upwardly closed breechblock housing 1, consisting of two parts, an outer casing part 2, which is pressed from thin sheet iron (1.5–2 mm) and an inner precision-case part of steel, which has two thick end portions 3 and 4 having the full height of the housing, and a relatively thin intermediate portion 5 extending between the end portions and which is approximately half as high as the outer casing (FIG. 2). These housing parts are designed to engage with each other, rigidly mutually attached in such a way that after being joined together they can be heat treated, e.g. case-hardened. A suitable method for this is brazing, but even other methods are conceivable. The inner housing part serves to stiffen the outer thinner part, and is shaped, inter alia, with necessary guiding surfaces for parts moving in the upper portion of the housing. The forward end portion 4 of the inner part forms the front end wall of the housing, the gun barrel 6 and a tubular cartridge magazine 7, arranged under and parallel to the barrel, being attached to said end wall. The rear end portion 3 of the inner housing part forms the rear end wall of the housing, to which the gun stock is attached, the latter having a tube containing a propulsion spring 9 arranged in it.

Figure 3:
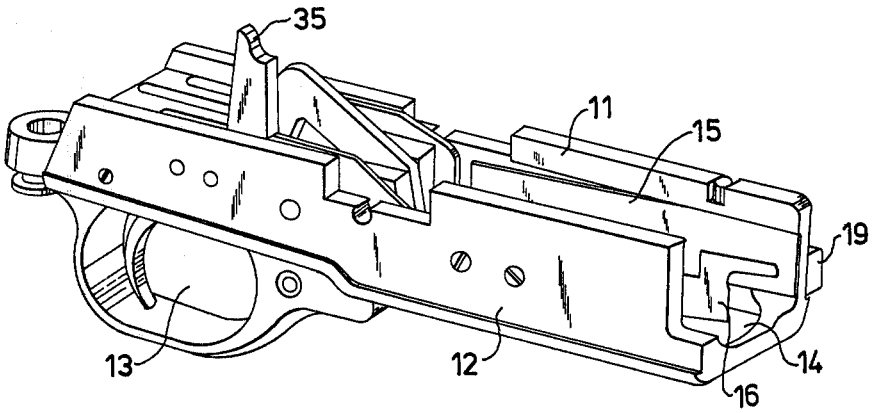

To the lower portion of the end walls of the housing, there is attached a lower mounting 10 with upstanding side walls 11 and 12 projecting into the lower portion of the housing, engagement of the walls against the inner sides of the outer casing part 2 giving these sides support (FIG. 3). In the lower mounting are mounted in a known manner a trigger mechanism 13, and a cartridge feeding flap 14 for lifting up the cartridges into the upper portion of the breech-block housing. Two cartridge catches 15 and 16 are also arranged in the forward portion of the lower mounting, to regulate the feeding of the cartridges into the housing so that only one at a time is fed into the lower mounting immediately above the cartridge feeding flap 14 by a cartridge propulsion spring 17 arranged in the magazine 7. The left-hand cartridge catch 15 is a pivotally mounted rocker catch, and is arranged to be guided into a locking position by the cartridge sliding into the lower mounting, while the right-hand cartridge catch 16 is an inwardly sprung catch attached to the side wall 12, and is arranged to be guided out of its locking position by an actuating surface 18 formed on a reciprocating slide. The cartridge catch 15 is provided with a thumb plate 19 enabling manual operation.

Figure 4:
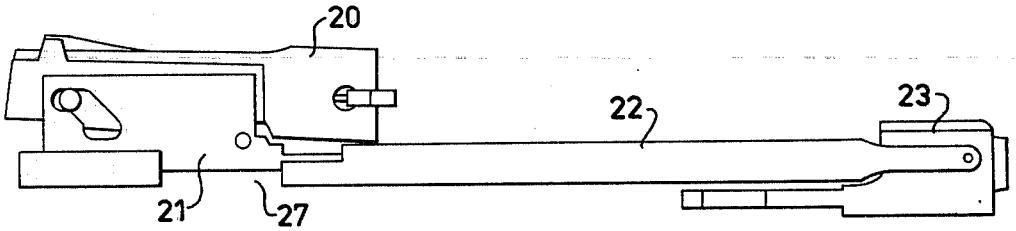
Figure 5:
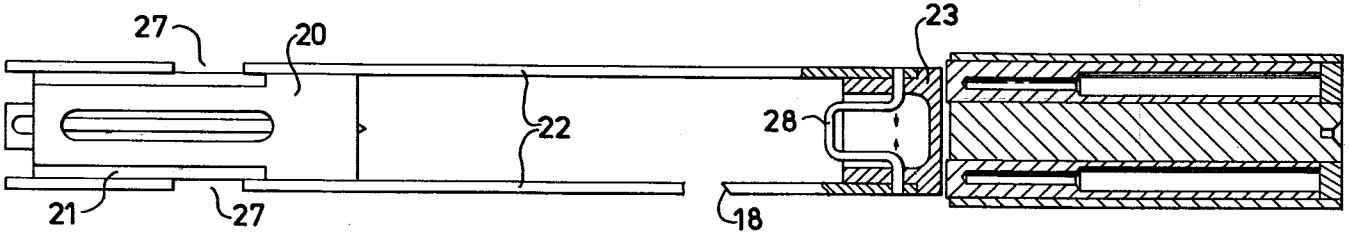
Figure 6:
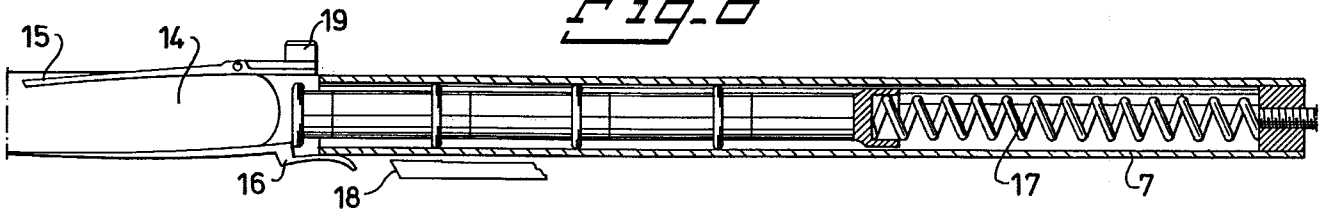

The said slide consists of an action piece 21 carrying a breechblock 20, and having two long, forwardly projecting, rectangular rails 22 with a cross-piece 23 attached to their forward ends, the rails being attached to the side surfaces of the action piece 21 down in their lower parts (FIGS. 4 and 5). The slide is displaceably guided by the rectangular rails 22 engaging against the outer casing part 2, against the lower edges 24 formed as sliding surfaces of the inner part, and against the upper edge surfaces of two steel guiding abutments 25, each of which is attached to one of the side walls of the outer casing 2 by brazing or other method equivalent thereto from the point of view of heat treatment. The rails also run in rectangular slots made in the front end wall 4 of the housing, and covered by the outer casing part 2. The upstanding side walls 11 and 12 of the lower mounting 10 also have their upper edge surfaces formed as flat sliding surfaces, which lie on a level with the upper edges of the guiding abutments 25 by the side walls 11 and 12 being made with recesses for the abutments 25. The latter are made with downwardly directed flanges 26 which engage around the side walls 11 and 12 when the lower mounting is introduced into the housing. The need is hereby eliminated of a through-bolt holding together the side walls of the outer casing part.

To enable removal of the action piece 21 from the housing, its rails 22 have an opening 27 somewhat longer than the guiding abutments 25, and approximately at the middle of the action piece. When these openings 27 pass the guiding abutments the slide is given support by the walls of the lower mounting, which are otherwise not suitable as guiding means because they are made from light metal. To facilitate removing the action piece from the housing, the cross-piece 23 must be easily removable from the front ends of the rails. This is enabled by a simple attachment device consisting of an outwardly sprung wire bow 28, having the extremities of its legs outwardly bent and introduced as locking pins into coincident holes in the cross-piece and rails 22. Pressed down backwards, the wire bow assumes a locking position, but when lifted and pressed forwards, the leg ends are drawn out of the rail holes by the bow being pressed together as it slides against a rounded edge surface on the cross-piece (FIG. 5).

The cross-piece is arranged to run in a space between the barrel and the cartridge magazine and is in front made with an impact surface against which two gas pistons arranged in the same space work to move the slide backwards on reloading. The pistons are actuated in a known way by gas outlets from the barrel.

The breech-block 20 is pivotally mounted in and operated by the action piece in a known way so that moved forwardly to a position sealing the cartridge chamber it is lifted up and locked against a locking surface 29 in the breech-block housing. This locking surface 29 is made by an opening in the intermediate portion 5 of the inner housing part, similar to necessary recesses in the housing for projecting details on the action piece and breech-block. This simplifies machining to a great degree, since it can then be peformed from the outside.

The propulsion spring 9 is arranged to move the slide forward via a propulsion rod 30 coupled to the action piece 21.

On its right side the action piece 21 is provided with a removably attached handle 31 to enable manual backward movement of the slide. The handle is arranged at the lower edge of a thin steel plate 32 with approximately the same size and shape as an ordinary ejection opening for the cartridges in the right side wall of the casing (FIG. 7). The plate 32 is introducible through the ejection opening to engage with the flat side surface of the action piece, thereby pressing in a spring-loaded pin 33 mounted in the action piece (FIG. 1). The plate is now somewhat displaceable backwards with its rear edge inside the outer casing part of the housing. At this backward displacement, the pin 33 snaps into a hole 34 in the plate 32 and locks it to the action piece. The handle 31 runs in a backwardly directed slot starting from the ejection opening.

What is claimed is:

1. A firearm mechanism comprising, in combination, an upwardly closed and downwardly open breech-block housing substantially U-shaped in cross-section and having two end walls arranged for mounting a stock and a barrel respectively to said housing, a breech-block arranged to be guidably moved reciprocally in said housing by propelling and repelling means, a lower mounting for closing said breech-block housing and having upstanding side walls for supporting a trigger mechanism and cartridge feeding means and which, after insertion from below into a closing position, projects into said breech-block housing, said breech-block housing formed as a composite construction, comprising a preferably precision-cast inner housing part having two end portions constituting said housing end walls and a relatively thin, intermediate portion extending only in an upper portion of said housing between said end portions and an outer casing part of thin sheet metal formed by pressing and extending throughout the full height of said housing, said inner housing part being covered by and fixedly connected in close contact by brazing or the like with said outer casing part so as to stiffen said outer casing part.

2. A firearm mechanism as defined in claim 1 wherein said inner housing part only is provided with recesses, locking surfaces and guiding surfaces in said breech-block housing and including openings in said thin intermediate portion.

3. A firearm mechanism as defined in claim 1 wherein said lower mounting side walls have upper edges each provided with a recess and wherein said outer casing part includes a pair of side walls and an abutment mounted on each of said outer casing part side walls inside said breech-block housing, preferably by brazing, said abutments being provided with a downwardly directed flange for engagement with said recesses in said lower mounting side walls to thereby stiffen said outer casing part abutting against said side walls.

4. A firearm mechanism as defined in claim 1 wherein said lower mounting side walls have upper edges each provided with a recess and wherein said outer casing part includes a pair of side walls, a guiding abutment mounted, preferably by brazing, on each of said side walls inside said breech-block housing in spaced relationship with the lower edge of said inner housing part, each of said abutments including an upper guide edge forming a sliding surface, a plurality of rails for supporting said breech-block and slidably engageable with the sliding surfaces of said abutments, upper and lower edges for said guided reciprocal movement of said breech-block in said housing, said rails including a rear portion and a front portion defining a gap therebetween somewhat longer than said guiding abutments, said guiding abutments being accommodated within said recess in said lower mounting side walls, with said lower mounting side walls upper edges arranged to provide sliding surfaces for said rails on a level with said sliding surfaces on said guiding abutments said guiding abutments including a downwardly directed flange for engagement with said lower mounting side walls to thereby stiffen said outer casing part abutting against said lower mounting side walls.

5. A firearm mechanism as defined in claim 4 wherein said rails extend through said housing front end wall in forwardly projecting relationship therewith and including a cross-piece removably attached to the front ends of said rails, said cross-piece including a U-shaped, backwardly open recess to provide a pair of legs, the outer surface of said legs being provided with longitudinally extending grooves for accommodating the front end portions of said rails, said cross-piece legs and said rails having holes coinciding in the mounted position of said cross-piece on said rails, an outwardly sprung wire bow having outwardly bent legs and extending into said holes to provide locking pins rotatably mounted in said holes to removably lock said cross-piece to said rails, said pins being disposed in a locking position when said wire bow is folded backward and being withdrawn from said holes in said rails when said bow is pressed forwards as a result of the bow being pressed together by its engagement with the rounded limiting surface of the interior of the U-shaped recess.

* * * * *